US005880655A

United States Patent [19]

Dittmann et al.

[11] Patent Number: 5,880,655

[45] Date of Patent: Mar. 9, 1999

[54] ELECTROMAGNETIC RELAY

[75] Inventors: Michael Dittmann; Titus Ziegler, both of Berlin, Germany

[73] Assignee: Siemens Aktiengesellschaft, Munich, Germany

[21] Appl. No.: 52,174

[22] Filed: Mar. 31, 1998

[30] Foreign Application Priority Data

Apr. 2, 1997 [DE] Germany ..... 197 13 659.1

[51] Int. Cl.[6] ..... H01H 51/22

[52] U.S. Cl. ..... 335/78; 335/80

[58] Field of Search ..... 335/78–86, 124, 335/128, 202

[56] References Cited

U.S. PATENT DOCUMENTS

| | | | |
|---|---|---|---|
| 5,270,674 | 12/1993 | Nakanishi et al. | 335/80 |
| 5,440,285 | 8/1995 | Nakanishi et al. | 335/78 |
| 5,673,012 | 9/1997 | Stadler et al. | 335/78 |

FOREIGN PATENT DOCUMENTS 195 20 220 C1 6/1995 Germany .

WO 94/22156 3/1994 WIPO .

*Primary Examiner*—Lincoln Donovan

*Attorney, Agent, or Firm*—Hill & Simpson

[57] ABSTRACT

The relay includes a coil assembly enclosed in a top enclosure made from insulating material. The coil assembly includes a spooled coil body, a core, pole shoes and winding terminal elements assembly and is disposed above a pivoting armature which is connected to contact springs via a carrier element of insulating material. The relay also includes a base made from insulating material and which contains terminal paths for stationary cooperating contact elements as well as contact terminal elements. The armature is disposed above the base via bearing supports and bearing bands integrated in the contact springs. A frame is disposed over the base and forms a housing for the relay together with the base and with the top enclosure. The housing encapsulates the contact space of the relay, wherein the frame with the base represents the lower housing part and the top enclosure for the coil assembly represents the upper housing part.

16 Claims, 3 Drawing Sheets

ELECTROMAGNETIC RELAY

FIELD OF THE INVENTION

The invention relates to an electromagnetic relay. More specifically, the present invention relates to relays which include: a coil is enclosed in insulating material and containing a spooled coil body, a core is arranged axially in the coil body with core pole shoes adjoining the ends of the core perpendicularly and directed downwards and integrated winding terminal elements, wherein the coil axle is parallel to the bottom of the relay; a swivelling armature is arranged beneath the coil parallel to its axle and forming at least one working air gap with the pole shoes; contact springs actuated via the armature; and a base of insulating material is provided which forms the floor of the basic plane of the relay with its bottom and which contains terminal paths for stationary cooperating contact elements as well as contact terminal elements for moving and stationary contact elements, and wherein the armature is disposed above the base.

BACKGROUND OF THE INVENTION

In DE 195 20 220 C1, a relay is disclosed with a body which forms the sidewalls of the housing serves therein for the separation of the contact space from the coil space. The body is made of insulating material and has an H-shaped profile which accepts the coil, permanent magnet and pole shoes and overlaps the base. Furthermore, the coil space is filled with a sealing compound up to an upper edge of the basic body following insertion of the coil, permanent magnet and pole shoes. The attachment of a housing cover is a separate step. This additional step makes the production of the relay costlier. In addition, the sidewalls of the basic body which overlap the base offer poor accessibility to armature, carrier element and stationary and moving contact elements as well.

WO 94/22 156 teaches a polarized electromagnetic relay in which magnet system, armature and base are respectively arranged over one another in the aforementioned order. There, however, the coil with the components appurtenant thereto is not coated, so that this relay contains none of the contact space encapsulated by the windings of the coil. In addition, this relay does not contain any specific fastening possibilities for the various individual parts of the magnet system. Besides only weak assembly accessories, the structural shape of relay taught by WO 94/22 156 comprises a lower mechanical stability conditional to not accepting a coated basic body as carrier element for the components of the magnet system. This poses a disadvantage, insofar as the working air gap can misadjust during assembly. In addition, there exists no metal protection against the coil wire vapors or exhalations which could arise, for example, in the SMT soldering process.

SUMMARY OF THE INVENTION

It is the object of the invention to realize a simplified and automated assembly of a relay as well as a cost-effective production of the same. The improvement of the accessibility of the base at which the armature is disposed and which contains the stationary and moving contact elements is therein especially relevant. In addition, it is intended that the voltage stability between the contacts and the winding be increased through constructive features for a compact structural shape. In addition, the design of the housing has to guarantee a high thermal dimensional stability.

This is inventively achieved, in that a frame pushed over the base together with an enclosure of the coil, forms a housing for the relay, this housing encapsulating the exterior contact space of the relay, wherein the frame with the base represents the lower housing part and the enclosure represents the upper housing part.

The inventive relay thereby realizes the main goals on which the development based, namely to make available an encapsulated contact space free of harmful vapors of the coil wire, in a compact and mechanically stable design of the relay. At the same time, the division of the housing into an upper part which is formed by the enclosed coil and a lower part which is formed by the base and the inventive frame guarantees a better accessibility for the insertion of pole shoes and/or additional permanent magnets in case the inventive relay is used in a polarized embodiment. In addition, assembly and accessibility to the base assembly is easier because of the splitting of the housing into two parts. At the same time, the mechanical stability of the base subassembly is improved by the frame, since the former receives additional support from the latter. It is also to be seen as advantageous that there is a part of the housing is already formed by the enclosure of the coil, so that a separate component is not needed therefor. Further, the goal of keeping the terminal paths for the contact elements as short as possible in order to minimize the necessary space requirements is provided for by the arrangement of the coil, carrier of insulating material—with the armature secured thereto and the embedded contact springs—and the base in layers, residing one on top of the other.

In an embodiment, the enclosed coil assembly comprises a stepped tapered structure at the lower edge of the enclosure. The frame can be thereby pushed over the edge of the enclosure and onto the enclosure to form an overlapped area, whereby the mechanical stability of the housing is additionally increased. The mechanical stability of the connection between the enclosed coil—as the upper part of the housing—and the frame, together with the base—as the lower part of the housing—can be increased by additional clamping elements at extensions of the enclosed coil, winding terminal elements being embedded therein. These clamping elements are preferably realized in the form of stepped enlargements at the lower end of the extensions whereby frame and enclosure are connected in a press fit. A further stiffening or bracing of the housing is thereby provided.

In an embodiment, retainer projections are attached at the lower edge of the frame. These retainer projections wrap around the base, whereby the latter is fixated. In addition, the enclosure can contain insertion pockets into which the pole shoes are pushed and secured by a press fit. Alternatively, or additionally, permanent magnets effecting a like magnetic polarization at opposing ends of the core can be inserted in the pockets. In this case, in order to lower the magnetic resistance, the core, which is arranged axially in the coil body, is to be enlarged by another core piece, so that the core comprises a T-shaped basic structure. The core piece is to be arranged perpendicularly to the coil axis and underneath the core centrally, the core piece being therein inserted in a recess in a central flange of the coil body and connected with the core via a flange. In an embodiment, clamping elements in the form of cross-ribs are to be potentially provided in the insertion pockets. The clamping elements improve the seat of the elements of the magnet system arranged therein.

In an embodiment, it is conceivable to co-embed the elements of the magnet system in the enclosure. Admittedly, an additional expenditure of tools is necessary therefor for fixating these elements during the molding in or coating with insulating material.

In an embodiment, the enclosure of the relay is equipped at its lower side with longitudinal ribs running parallel to the coil axle. The longitudinal ribs preferably extend exactly in the area between the permanent magnets, or respectively, the pole shoes, so that an additionally assembled core piece, or respectively, a permanent magnet which creates a like polarization at the ends of the pole shoes, is accommodated in the space delimited by two longitudinal ribs and the permanent magnets, or respectively, the pole shoes. The interior flanks of the longitudinal ribs can be therein provided with additional cross-ribs which fixate the abovementioned elements of the magnet system in their position. The height of the longitudinal ribs is to be fitted to the desired region of adjustment for the working air gap. In addition, the function of the longitudinal ribs lies in insulating the bearing supports and bearing bands for the armature which are electrically connected to the central contact terminal elements from the other elements of the magnet system.

The bearing of the armature at the base and the bonding of the connection between contact springs and central contact terminal elements can be further improved by a special design of the bearing supports. The bearing supports are therein bent around in a "U" shape at their free ends, whereby they form a clamping plate for the bearing bands located therebetween, thus fixating these bands and securing them against dislocation. The point of fixation at the clamping plate formed thereby is formed by the bending point for the bearing band. At the same time, with this advantageous construction, the armature rocker movement puts mere bending stress on the bearing band. In addition, an additional welding point is to be provided for increasing the stability at the point of fastening this welding point being attached either laterally and axially to the armature swivel or diagonally to this axle at the bearing support.

In an embodiment, sealing compound, for example epoxy resin, is applied at the lower side of the relay, thereby sealing the relay in the region between frame and base. In addition, the sealing compound is drawn further into the capillaries during thermal hardening and thus also seals the joints between frame and enclosure (as the upper housing part), such that the enclosure and frame are glued together in this way. It is alternatively conceivable that sealing compound, or respectively, epoxy resin, is applied on the housing in the region of the stepped taper at the enclosure, thereby gluing the housing in the overlapped region.

In an embodiment the relay can be used in SMT assembly processes. The contact elements and winding terminal elements protrude downward from the base and can be shaped into SMT terminal lugs at their free ends. In an embodiment, it is possible to form the lower portions of the terminal elements into press-fit pins, especially as the embodiment already comprises many constructive features guaranteeing a high mechanical stability of the components, whereby no serious misadjustments of the mechanical parameters by means of press-fit pins on a conductor carrier are to be expected in assembly.

In an embodiment, the present invention provides an electromechanical relay comprising a coil assembly encased in insulating material. The coil assembly comprises a hollow coil body around which a coil is spooled. The coil body accommodates a core that extends axially through the coil body and which includes two opposing ends. Each opposing end of the core engages a pole shoe. Each pole shoe extends perpendicularly downward from the core. The coil has two opposing ends. Each opposing end is connected to a winding terminal element. The coil is disposed above a pivoting armature with working air gaps disposed between each pole shoe and the armature. The armature is connected to a contact spring whereby pivotal movement of the armature results in movement of the contact spring relative to two stationary contact elements. The contact spring is disposed above a base fabricated from insulating material. The base forms a bottom of the relay and comprises terminal paths for stationary contact elements and at least two contact terminal elements. The base is connected to a frame to form a lower housing for the relay and the frame is connected to a top enclosure. The top enclosure forms an upper housing for the relay. The base, frame and top enclosure together form an encapsulating housing for the relay.

In an embodiment, the top enclosure comprises a lower edge. The lower edge of the top enclosure overlaps the frame.

In an embodiment, the winding terminal elements are each connected to an extension. Each extension is connected to the coil assembly and extends downward therefrom.

In an embodiment, the frame comprises a lower edge which includes an inwardly projecting retainer projection which wraps around the base.

In an embodiment, the pole shoes are accommodated in pockets disposed between the top enclosure and the coil body.

In an embodiment, the top enclosure comprises a lower side that comprises two opposing longitudinal ribs that extend parallel to the coil axis. The top enclosure and the two opposing ribs being unitary in construction.

In an embodiment, the base comprises an underside that is sealed by a sealing compound.

In an embodiment, the frame is glued to the base and the top enclosure.

In an embodiment, at least one permanent magnet is disposed between the pole shoes and beneath the coil and provides a life polarization at each pole shoe.

In an embodiment, the permanent magnet is held in place by the longitudinal ribs.

In an embodiment, the permanent magnet is connected to each pole shoe by laser welding.

In an embodiment, the longitudinal ribs comprise inwardly protruding portions that extend towards the permanent magnet to press fit the permanent magnet between the ribs.

Other objects and advantages of the present invention will become apparent from reading the following detailed description and appended claims, and upon reference to the accompanying drawings.

BRIEF DESCRIPTION OF THE DRAWINGS

The invention is further illustrated below using the drawing, wherein.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
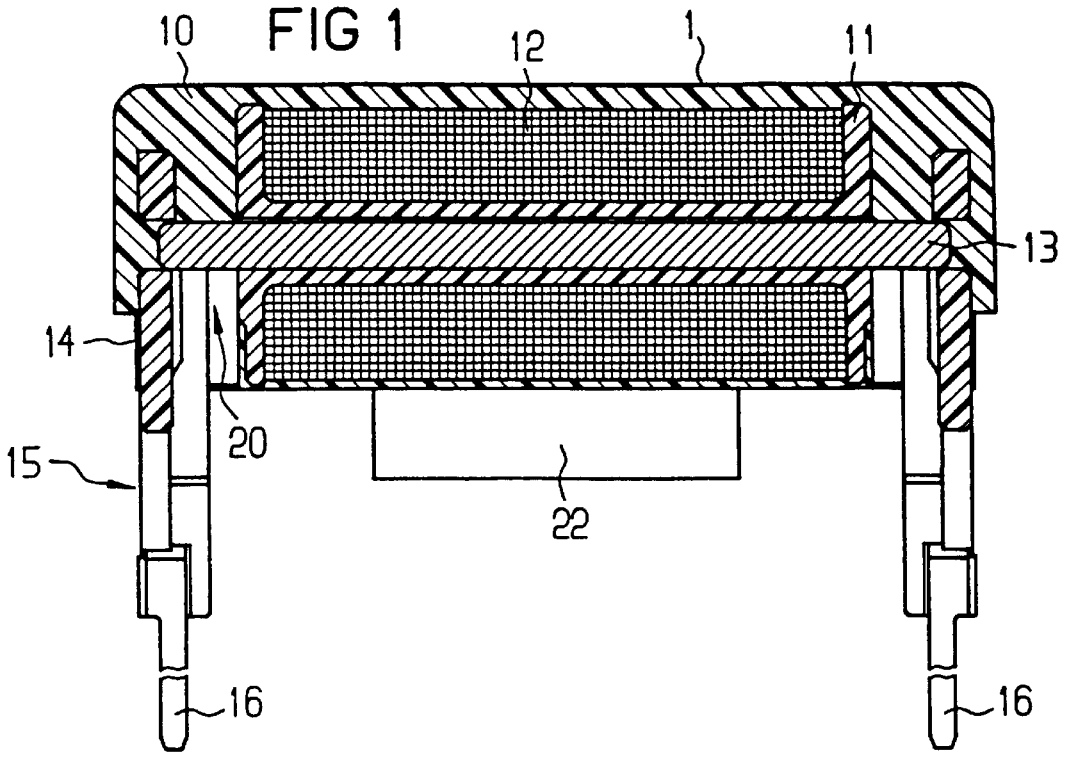
FIG. 1 is a cross-sectional view of a longitudinal section of an enclosed coil of a relay made in accordance with the present invention.
Figure 3:
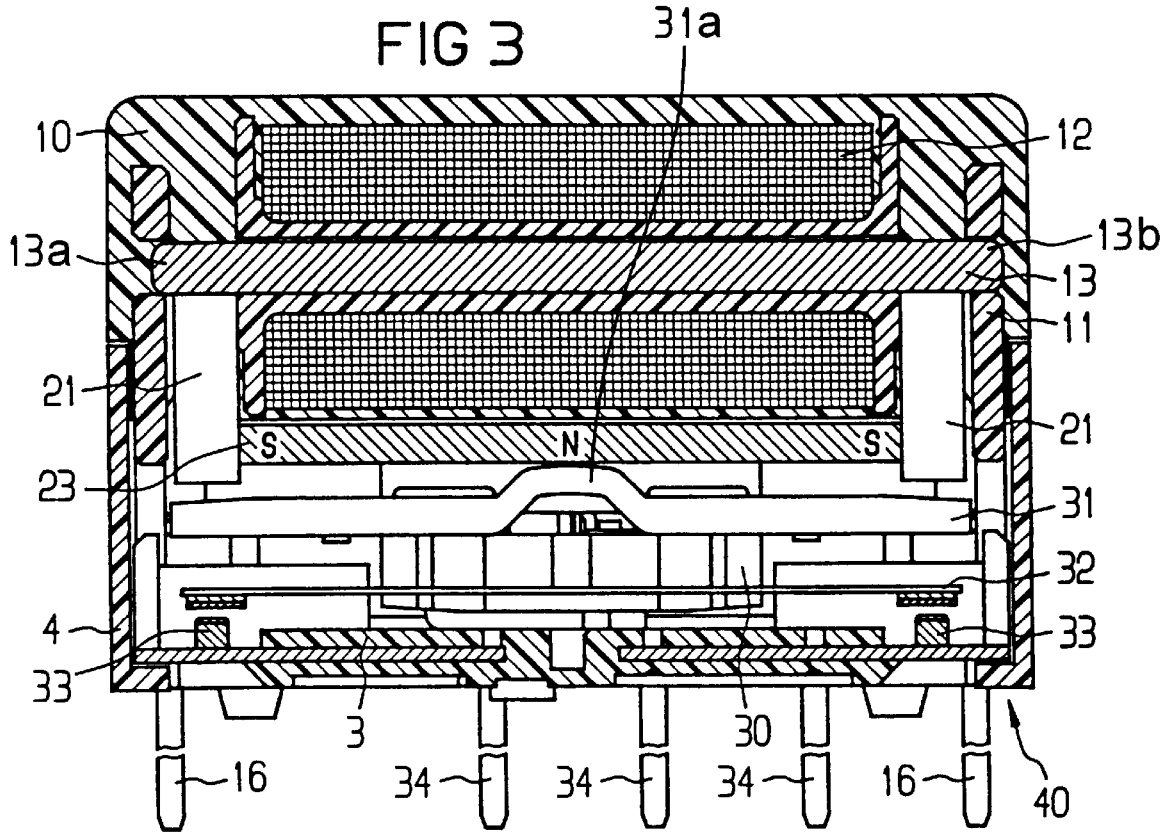
FIG. 3 is longitudinal section of the relay shown in FIG. 1.
Figure 4:
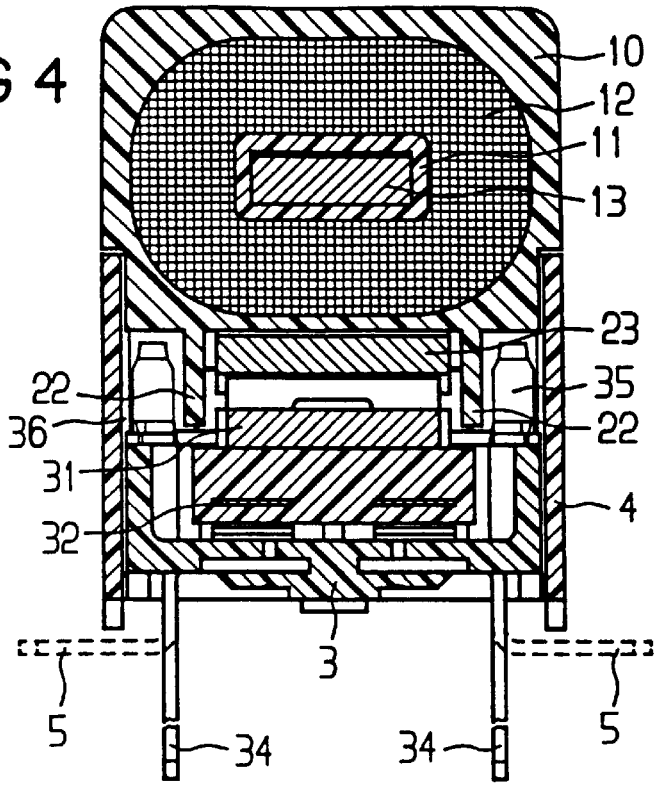
FIG. 4 is a cross-sectional view of one embodiment of the relay of the present invention.

The enclosed coil assembly 1 depicted in FIG. 1 comprises a coil body 11 that accommodates a winding 12 as well as a magnet core 13 arranged axially in the coil body 11. Extensions 15 are formed at the enclosed coil 1 perpendicularly to a coil axis and facing downward. Winding terminal elements 16 are embedded in the extensions 15. Referring to the exemplifying embodiment in FIG. 1, insertion pockets 20 for two pole shoes 21 are clearly discernible. The core shoes 21 engage opposing ends 13*a*, 13*b* of the core 13. In addition, a pair of longitudinal ribs 22 is formed in one piece in the lower part of the enclosure 10. The longitudinal ribs are of such a height that a permanent magnet 23 and an armature 31 are accommodated in the space delimited by these ribs and the pole shoes 21 (FIG. 4). The permanent magnet 23 comprises a tripolar arrangement wherein the two outer poles are alike and the middle pole is poled in opposition thereto (FIG. 3). Furthermore, an overlapped region 14 (FIG. 2) is clearly discernible at the lower edge of the enclosure 10. This overlapped region 14 additionally serves to stiffen the housing formed by the enclosure 10, frame 4 and base 3, whereby enclosure 10 and frame 4 are glued together in the overlapped region 14.

Figure 2:
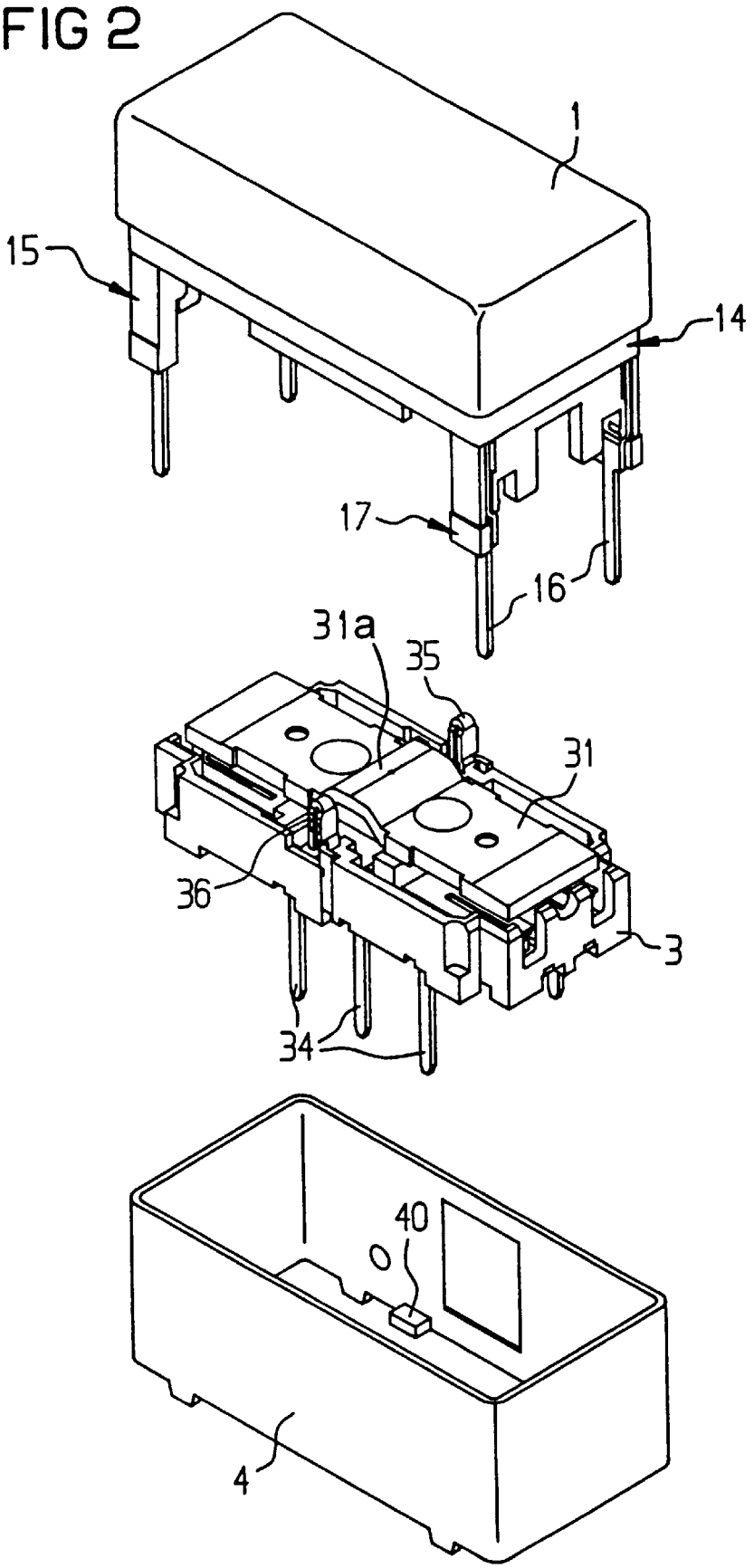
FIG. 2 is an exploded perspective view of the main components of the relay shown in FIG. 1 (frame, base with armature and contact springs as well as enclosed coil)

FIG. 2 depicts the subcomponents of the inventive relay. The frame 4 and the base 3 are therein included as the lower housing part, whereby the armature 31 is disposed at the base 3 via bearing supports 35 (FIG. 4) and bearing bands 36 (FIG. 2), this armature 31 being securely riveted to a carrier element 30 of insulating material (FIG. 3). Furthermore, a contact spring 32 are embedded in the carrier element 30, the spring (32) being connected to the bearing bands 36. Above this arrangement, the enclosed coil 1 is located, whose extensions 15 wrap around the base 3. Additional clamping elements 17, which are integrated into the lower ends of the extensions 15 in the form of stepped enlargements, offer the housing an additional structured rigidity, since the upper and lower housing parts are connected with each other in a press fit. In addition, the mechanical stability of the arrangement—comprising enclosed coil 1, frame 4 and base 3—is thereby increased, in that, at its lower edge, the frame 4 comprises a retainer 40 projecting wrapping around the base 3, by which projections of the base 3 are additionally fixed within the frame 4. At the same time, these constructive measures give the frame 4 better stability. (See FIGS. 2 and 5).

Through advantageous formation of the enclosed coil 1, the pole shoes 21 are inserted into pockets 20 provided therefor in the enclosure 10. In addition, the seat of the pole shoes 21 is improved by additional clamping elements in the form of longitudinal ribs or cross-ribs. The permanent magnet 23 is arranged longitudinally between the pole shoes 21. This permanent magnet is accommodated in the space delimited by the pole shoes 21 and longitudinal ribs 22. The permanent magnet 23 is secured between the abovementioned elements by press fit. In addition, clamping elements in the form of cross-ribs or longitudinal ribs are additionally provided at the flanks of the longitudinal ribs 22 which are directed to the permanent magnet 23. Alternatively, it is conceivable that the permanent magnet 23 is secured with the pole shoes 21 by laser welding and so receives a more secure attachment. It is also possible to attach the magnet 23 through a deformation of the longitudinal ribs 22 in their edge regions, whereby the permanent magnet 23 is held through a beading of the edge regions.

A bearing ridge 31*a* is provided running diagonally in the middle of the armature 31 for reducing the magnetic resistance between the armature 31 and the center pole of the permanent magnet 23. The pivot point of the armature is therefore provided by the bearing supports 35, bearing bands 36 and bearing ridge 31*a* (see FIG. 2 and FIG. 4). The two bearing bands 36 are attached to the contact springs 32 in one piece and bent away upwards perpendicularly to the plane of the base 3. There they reside immediately adjacent to the bearing supports 35 protruding perpendicularly from the base 3. The bearing supports 35 are connected directly to the central contact terminal elements 34. The bearing supports 35 are bent around in a "U" shape in their end region to form clamping elements which fixate the bearing bands 36.

Figure 5:
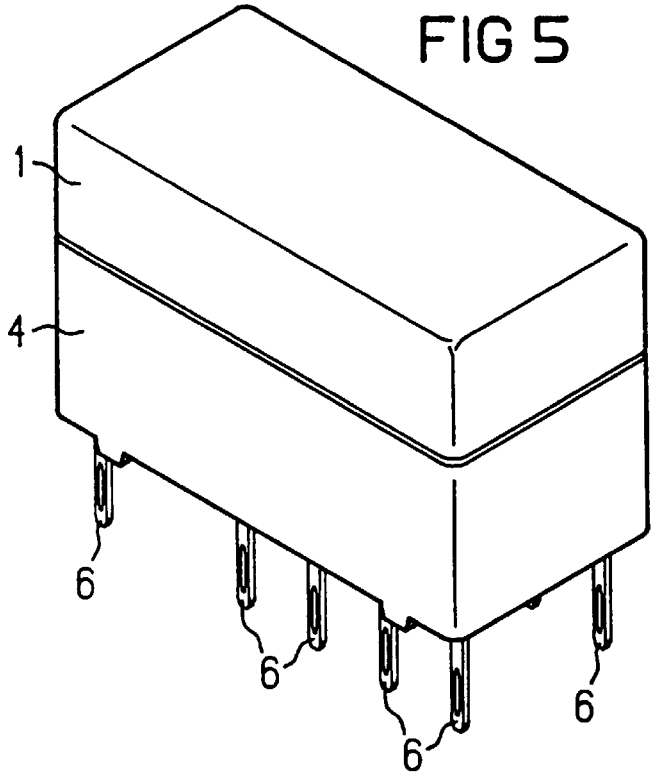
FIG. 5 is a perspective view of the relay, an alternative embodiment in a fully assembled condition.

In addition, stationary contacts 33 are embedded in the base 3 as cooperating contact elements which are connected to the contact terminal elements 34 via terminal paths provided in the base 3 (see FIG. 3 and FIG. 4). The terminal paths, together with the contact terminal elements 34 for the contacts are advantageously cut from a single piece of conductor sheet, wherein the terminal paths are formed by sheet sizing, and the contact terminal elements 34 are produced by bending of the terminal tabs out of the basic plane of the conductor sheet. In production this guarantees a simple mechanical handling of the terminal paths and contact terminal elements 34 formed in the base 3. FIG. 4 depicts the formation of the contact terminal elements and of the winding terminal elements into SMT terminal lugs 5. FIG. 5 shows the alternative design of the contact terminal elements and of the winding terminal elements as press fit pins 6. However, the contact terminal elements are no longer connected with the terminal paths in one piece therein; rather, they are inserted through recesses provided in the terminal paths, wherein the press fit pins are connected with the terminal paths in the region of the recesses by press fit and cold welding.

The housing, comprising the enclosed coil 1, the frame 4 and the lower part of the base 3, is additionally stiffened by an applied epoxy resin layer in the region of the joint between frame 4 and base 3. As a result of the capillary effect, the resin is drawn further up into the joints and thus secures the frame 4 along with the enclosure 10 in the region of the joints at the overlapped region 14 between frame 4 and enclosure 10 (see FIG. 3 and FIG. 4).

All in all, the method for construction of the inventive relay excels therein, that it comprises a high mechanical stability, which is absolutely essential precisely in the use of relays in assembly processes in which high mechanical stresses arise. The set parameters, particularly the size of the working air gap, are thereby resistant to misadjustment to the furthest extent possible. In addition, only a comparatively small number of individual parts are necessary in the assembly, or respectively, in the production of the relay, which significantly simplifies an automated production routine, thus resulting in lower unit prices in production.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

We claim:

1. An electromechanical relay comprising:

a coil assembly encased in insulating material which forms a top enclosure, the coil assembly comprising a hollow coil body around which a coil is spooled, the coil body accommodating a core that extends axially through the coil body, the core comprising two opposing ends, each opposing end of the core engaging a pole shoe, each pole shoe extending perpendicularly downward from the core, the top enclosure comprising a lower side that comprises two opposing longitudinal ribs that extend parallel to the coil axis, the top enclosure and two opposing longitudinal ribs being unitary in construction, the coil having two opposing ends, each opposing end being connected to a winding terminal element, the coil being disposed above a pivoting armature with working air gaps being disposed between each pole shoe and the armature, the armature being connected to a contact spring whereby pivotal movement of the armature resulting in movement of the contact spring relative to two stationary contact elements, the armature being disposed between the two pole shoes and the two opposing longitudinal ribs, the contact spring being disposed above a base fabricated from insulating material, the base forming a bottom of the relay and comprising terminal paths for the stationary contact elements and at least two contact terminal elements, the base being accommodated in a bottom of a frame to form a lower housing for the relay with the frame, an upper end of the frame matably receiving the lower side of the top enclosure, the frame connecting the base to the top enclosure, the core and a top portion of the top enclosure being disposed above the frame, the top enclosure forming an upper housing for the relay, the base, the frame and the top enclosure forming an encapsulating housing for the relay.

2. The relay of claim 1 wherein the winding terminal elements are each connected to an extension, each extension being connected to the coil assembly and extending downward therefrom.

3. The relay of claim 2 wherein each extension has a lower end that comprises a clamping element that connects said extension to its respective winding terminal element, the clamping elements each extending laterally outward to form stepped enlargements for fictionally engaging the frame and fictionally securing the frame to the coil assembly.

4. The relay of claim 1 wherein the frame comprises a lower edge, the lower edge of the frame comprises a retainer projection which wraps around the base.

5. The relay of claim 1 wherein the pole shoes are accommodated in insertion pockets disposed between the top enclosure and the coil body.

6. The relay of claim 1 wherein the base comprises an underside that is sealed by sealing compound.

7. The relay of claim 1 wherein the frame is glued to the base and the top enclosure.

8. The relay of claim 1 further comprising at least one permanent magnet disposed beneath the coil and between the pole shoes, the magnet providing a like polarization at each pole shoe.

9. The relay of claim 8 wherein the permanent magnet is connected between the pole shoes by laser welding.

10. The relay of claim 1 wherein the ribs comprise inwardly protruding portions that extend towards the permanent magnet to press fit the permanent magnet between the ribs.

11. The relay of claim 1 wherein the contact terminal elements and winding terminal elements protrude downward and laterally outward from the base to form SMT terminal lugs.

12. The relay of claim 8 wherein the contact terminal elements and winding terminal elements protrude downward from the base to form press fit pins.

13. An electromechanical relay comprising:

a coil assembly encased in insulating material which forms a top enclosure, the coil assembly comprising a hollow coil body around which a coil is spooled, the coil body accommodating a core that extends axially through the coil body, the core comprising two opposing ends, each opposing end of the core engaging a pole shoe, each pole shoe extending perpendicularly downward from the core with a permanent magnet disposed between the pole shoes, the magnet providing a like polarization at each pole shoe, the top enclosure comprising a lower side that comprises two opposing longitudinal ribs that extend parallel to the coil axis, the top enclosure and two opposing longitudinal ribs being unitary in construction, the coil having two opposing ends, each opposing end being connected to a winding terminal element, the winding terminal elements each being connected to an extension, each extension being connected to the coil assembly and extending downward therefrom, each extension having a lower end that comprises a clamping element that connects said extension to its respective winding terminal element, the clamping elements each extending laterally outward to form stepped enlargements, the coil being disposed above a pivoting armature with working air gaps being disposed between each pole shoe and the armature, the armature being connected to a contact spring by supporting structures whereby pivotal movement of the armature resulting in movement of the contact spring relative to two stationary contact elements, the armature being disposed between the two pole shoes and the two opposing longitudinal ribs, the contact spring being disposed above a base fabricated from insulating material, the base forming a bottom of the relay and comprising terminal paths for the stationary contact elements and at least two contact terminal elements, the base being accommodated in a lower end of a frame fabricated from insulating material to form a lower housing for the relay, a top end of the frame matably receiving the lower side of the top enclosure, the top enclosure forming an upper housing for the relay with the core and a top portion of the top enclosure being disposed above the frame, the clamping elements fictionally engaging the frame and fictionally securing the frame to the top enclosure, the base, the frame and the top enclosure forming an encapsulating insulating housing for the relay.

14. The relay of claim 13 wherein the pole shoes are accommodated in insertion pockets disposed between the top enclosure and the coil body.

15. The relay of claim 14 wherein the ribs comprise inwardly protruding portions that extend towards the permanent magnet to press fit the permanent magnet between the ribs.

16. An electromechanical relay comprising:

a coil assembly encased in top enclosure which forms a top enclosure, the coil assembly comprising a hollow coil body around which a coil is spooled, the coil body accommodating a core that extends axially through the coil body, the core comprising two opposing ends, each opposing end of the core engaging a pole shoe, each pole shoe extending perpendicularly downward from the core with a permanent magnet disposed between the pole shoes, the magnet being connected between the pole shoes by laser welding, the magnet providing a like polarization at each pole shoe, the pole shoes being accommodated in insertion pockets disposed between the top enclosure and the coil body, the top enclosure comprises a lower side that comprises two opposing longitudinal ribs that extend parallel to the coil axis, the top enclosure and two opposing longitudinal ribs being unitary in construction, the coil having two opposing ends, each opposing end being connected to a winding terminal element, the winding terminal elements each being connected to an extension, each extension being connected to the coil assembly and extending downward therefrom, each extension having a lower end that comprises a clamping element that connects said extension to its respective winding terminal element, the clamping elements each extending laterally outward to form stepped enlargements, the coil being disposed above a pivoting armature with working air gaps being disposed between each pole shoe and the armature, the armature being connected to a contact spring by supporting structures whereby pivotal movement of the armature resulting in movement of the contact spring relative to two stationary contact elements, the armature being disposed between the two pole shoes and the two opposing longitudinal ribs.

the contact spring being disposed above a base fabricated from insulating material, the base forming a bottom of the relay and comprising terminal paths for the stationary contact elements and at least two contact terminal elements, the base being glued to a bottom of a frame fabricated from insulating material to form a lower housing for the relay, the frame comprises a lower edge, the lower edge of the frame comprises a retainer projection which wraps around the base, the base comprises an underside that is sealed by sealing compound, the frame matably receiving and being glued to top enclosure, the top enclosure forming an upper housing for the relay, the top enclosure comprises a lower edge, the lower edge of the top enclosure overlaps the frame with a top portion of the top enclosure and the core being disposed above the frame, the clamping elements fictionally engaging the frame and fictionally securing the frame to the top enclosure, the frame connecting the base to the top enclosure, the base, the frame and the top enclosure forming an encapsulating insulating housing for the relay.

* * * * *